United States Patent [19]

Herubel

[11] 3,994,448

[45] Nov. 30, 1976

[54] DEVICE FOR FORMING AN INITIAL BIGHT OF A ROVING AROUND A BOBBIN IN AN AUTOMATIC TEXTILE WINDING MACHINE

[75] Inventor: Jean Frederic Herubel, Guebwiller, France

[73] Assignee: N. Schlumberger & Cie, Guebwiller, France

[22] Filed: Dec. 9, 1975

[21] Appl. No.: 639,049

[30] Foreign Application Priority Data

Dec. 13, 1974 France ..... 74.41116

[52] U.S. Cl. ..... 242/54.4; 242/74

[51] Int. Cl.[2] ..... B65H 75/16

[58] Field of Search ..... 242/54.4, 47, 74, 56 A

[56] References Cited

UNITED STATES PATENTS

| | | | |
|---|---|---|---|
| 3,633,839 | 1/1972 | Clark | 242/74 |
| 3,670,978 | 6/1972 | Draglsich | 242/54.4 |
| 3,908,924 | 9/1975 | Schulze | 242/56 A |

*Primary Examiner*—Edward J. McCarthy
*Attorney, Agent, or Firm*—Toren, McGeady and Stanger

[57] ABSTRACT

In an automatic textile winding machine comprising a driving cylinder on which rests a slubbing bobbin for being driven thereby, a device for automatically forming an initial bight of a roving around the slubbing bobbin at the commencement of winding comprises a suction nozzle for receiving the leading end of the roving emerging from the nip between the driving cylinder and the bobbin and a reciprocating bight-forming finger which, in moving between a rest position and an operative position, engages the roving extending between said nip and said suction nozzle, and lays it around the bobbin, an air jet carried by the finger then serving to blow the leading end of the roving into the nip between the bobbin and the driving cylinder again.

4 Claims, 6 Drawing Figures

1
2
6
4
29
f
13
23
11
12
32
17
3
18
16
14
30
28
27
31
15

3
13
17
16
29
I
30
23
11
6
4
21
22
1
12
28
27
I
31

1
6
4
5
13
2
12
11
29
f
32
17
3
18
30
16
14
15
28
27
31

3
13
B
16
23
11
29
17
21
30
22
1
2
12
6
A
4
28
27
31 f1
12
26
2
6
1
5
16
4
C
29
2
13
30
13
11
32
18
31
3
17
18
14
15
28
30
27

3
B
17
30
13
11
12
23
29
2
22
21
6
1
A
27
4
28
31

DEVICE FOR FORMING AN INITIAL BIGHT OF A ROVING AROUND A BOBBIN IN AN AUTOMATIC TEXTILE WINDING MACHINE

BACKGROUND OF THE INVENTION

This invention relates to a device for forming an initial bight of a roving around a slubbing bobbin in an automatic textile winding machine such as a roving frame, a flyer frame, an intersecting or the like of the kind comprising a horizontal rotary driving cylinder adapted for said slubbing bobbin to rest thereon and to be driven thereby, a roving guide actuated to be driven with a longitudinal reciprocating movement adjacent to the generatrix of contact of the slubbing bobbin and of the driving cylinder.

The automatic bobbin changing mechanisms generally operate in three phases, namely : ejection of a full bobbin, introduction of a new slubbing bobbin, and applying, to said new slubbing bobbin, the new end of the roving formed by breaking of the roving upon the ejection of the full bobbin. It is this last phase, in which the newly formed end of the roving is applied to the bobbin for starting the winding thereof, which the present invention proposes to improve.

In known mechanisms of the kind with which this invention is concerned, the leading end of the roving is presented freely to the slubbing bobbin and is formed in a loop thereover, for example, by a plate; thereafter the leading end is taken up in a more or less reliable manner by the nip between the driving cylinder and the slubbing bobbin, which has more especially the following disadvantages :

Since the roving end is free, that is to say that it is in no way controlled relative to the slubbing bobbin, its presentation to the nip is somewhat random, and it may arrive thereat in the least practical position in which case it may cause faulty winding, or clogging or obstruction of the bobbin and/or driving cylinder; accordingly, large losses of material can occur and considerable time is involved in manual rectification. It may also present itself crosswise or transversely at the side, or in any disadvantageous position, so that the member provided therefor may not always form a bight off the roving around the slubbing bobbin, which has the disadvantages already mentioned and results in untimely stoppages of the machine.

When the roving end is formed in a loop or bight around the slubbing bobbin, there is still a risk that it will not be taken up and entrained by the driving cylinder and the slubbing bobbin, which may also result in jamming, machine stoppages, losses of material and even the production of defectively-wound bobbins.

An object of the invention is to provide a device for forming an initial bight around the slubbing bobbin, with the leading end of the roving at the start of winding, which does not have the above-discussed disadvantages of the known devices.

With this object in view, the present invention provides a device for forming an initial bight of a roving around a slubbing bobbin at the commencement of winding, in an automatic textile winding machine, such as a spindle frame, an intersecting comber or the like, comprising a driving cylinder adapted for said slubbing bobbin to rest thereon and to be driven thereby, a roving guide adapted to be driven with a longitudinal reciprocating movement adjacent to the generatrix of contact of the slubbing bobbin and the driving cylinder, and pneumatic blowing means for applying the leading end of the roving to the slubbing bobbin, said device being characterised in that it comprises a suction nozzle for said leading end of the roving and situated substantially at the level of said generatrix of contact at a spacing from said generatrix to the downstream side relative to the direction of rotation of said driving cylinder, and a bight-forming finger disposed parallel to said generatrix and adapted to oscillate, parallel to itself, between a rest position below the space between said generatrix and said suction nozzle, and an operative position in which it is located above and behind said slubbing bobbin, having entrained with it said roving end in passing from its said rest position to its said operative position, said finger having at least one air jet which, when said bight-forming finger is in its operative position, is directed towards the nip between said driving cylinder and said slubbing bobbin, behind the latter, that is to say at the upstream side thereof, and which jet is then connected temporarily to a source of compressed air.

With such a device, upon the loading of a fresh bobbin, an extra length of the roving is caused to protrude from the nip between the driving cylinder and the bobbin, by reason of the roving being jerked forward by the bobbin, and this extra length extends to and is drawn out taut by the suction nozzle. The bight-forming finger, in its ascending movement from its lower position of rest, encounters the roving end held taut in this way and forms it into a loop or bight around the slubbing bobbin. At the end of the travel of the finger, when it is located above and behind said slubbing bobbin, its jet is fed with compressed air so as to blow the free end of the roving into the nip between the driving cylinder and the slubbing bobbin, at the side upstream of the generatrix of contact, so that the roving end is taken up and entrained between the driving cylinder and the slubbing bobbin. Taking account of the fact that, during the work cycle of the bight-forming finger, the roving guide shifts from one end to the other of the slubbing bobbin, it will be appreciated that the portion of roving delivered by the roving guide at the end of the cycle overlies the leading end portion of the roving; accordingly, tight turns are formed around the bobbin, these gripping tightly around the slubbing bobbin, which is particularly favourable for reliable starting of the winding of the roving.

Such an embodiment has a whole series of advantages :

Since the roving end is taut, it always presents itself in the same way, and correctly, to the slubbing bobbin, which reduces the risk of slippage and of jamming and accordingly results in a considerable saving of material and time for personnel. The result is an increase in the efficiency of the machine.

Since the roving end is controlled relative to the slubbing bobbin, because it is tautened, it always occupies a precise position and the bight-forming member is always capable of forming the roving into a bight around the slubbing bobbin, which avoids stoppages of the machine.

Because of the air blown through the jet of the bight-forming finger, the roving end is always reliably positioned between the driving cylinder and the slubbing bobbin, so that it is taken up in a reliable manner and always entrained thereby, which yet again eliminates causes of jamming, stoppages of the machine, losses of material, and the risk of producing defectively-wound bobbins.

By reason of the precise movements executed by the components of the device of the invention and because their positions are well defined and constant, the roving end always occupies the same position, which makes the machine very reliable.

The combination of the action of the roving bight-forming finger and of the movement of the roving guide ensures the formation of a bight and then of overlaid turns of the roving around the slubbing bobbin, which further increases the reliability of the machine.

In an advantageous embodiment, a horizontal table extends from adjacent the generatrix to said suction nozzle and the bight-forming finger, in said position of rest, is withdrawn beneath said table, through an opening in the latter. Thus, at the start of each winding cycle, the roving end, fed out by the driving cylinder and drawn taut by the suction nozzle, rests on the table while sliding thereover, which improves the precision of its positioning and facilitates its engagement by the bight-forming finger.

The invention will be described further, by way of example with reference to the accompanying drawings which show, by way of a non-restrictive example, one embodiment of a device in accordance with the invention.

Figure 1:
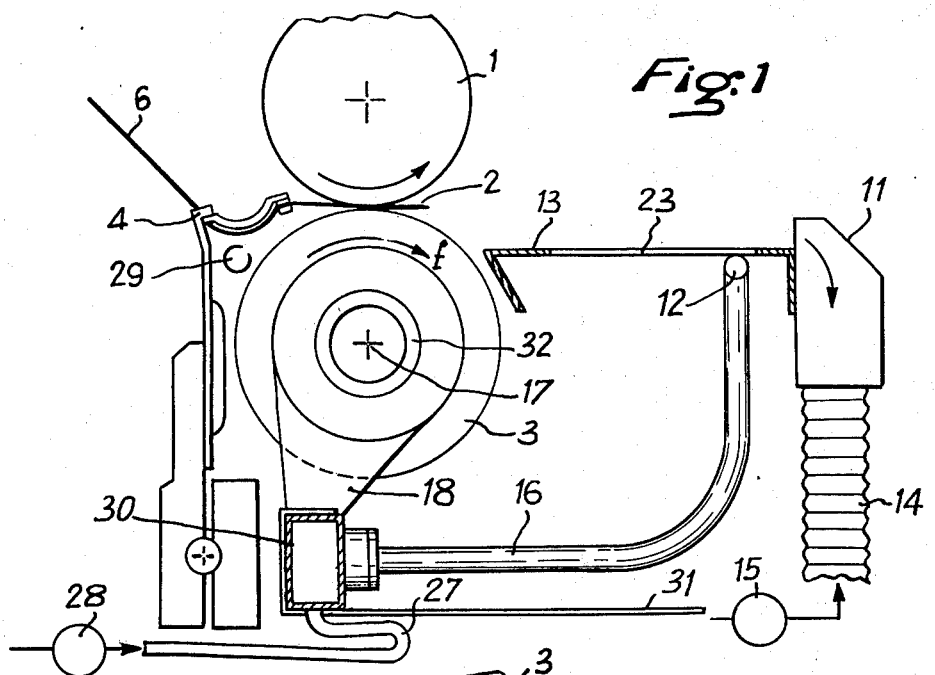
FIG. 1 is a diagrammatic sectional side elevation illustrating a preferred embodiment of the device of the invention in its condition immediately following the loading of an empty slubbing bobbin, the section being taken as indicated by the line I—I in FIG.2.

The device illustrated in the drawings serves to form an initial bight of a roving 2 around a slubbing bobbin 1 at the commencement of winding in an automatic textile machine such as a roving frame, a slubbing frame, a flyer frame, an intersecting comber, a finisher or a similar machine.

The machine comprises a horizontal rotary driving cylinder 3 for driving the slubbing bobbin 1 which rests on the said cylinder 3, and a roving guide 4 which is driven with a longitudinal reciprocating movement adjacent to the generatrix of contact 5 between the slubbing bobbin 1 and the driving cylinder 3.

The device which makes it possible to form the initial bight in the roving end 2 around the empty slubbing bobbin 1, which has just been put in place on the machine, comprises essentially a suction nozzle 11 for the roving end, a bight-forming finger 12 and, in the embodiment shown, a table 13.

The suction nozzle 11 for the roving end 2 is situated substantially at the same level as the generatrix of contact 5 between the driving cylinder 3 and the slubbing bobbin 1, at a spacing from the said generatrix 5, at the downstream side relative to the direction of rotation *f* of the driving cylinder 3. The suction nozzle 11 is connected to an exhauster or the like by a piping 14, under the control of an electrically-operated valve 15. The bight-forming finger 12 is a rectilinear element which extends parallel to the generatrix of contact 5 and it is carried by a bent arm 16 which can oscillate around geometric axis 17 of the driving cylinder 3. To this end, the arm 16 is fixed to a conduit 30 supported by two supports 18 of which one is provided at each end of the driving cylinder 3 and which enable the assembly to pivot about the axis 17. Each support 18 contains a self-lubricating bush 32 which enables it to pivot freely about the shaft providing the axis 17. The pivoting movement is imposed on the assembly by a drive member 31.

Figure 2:
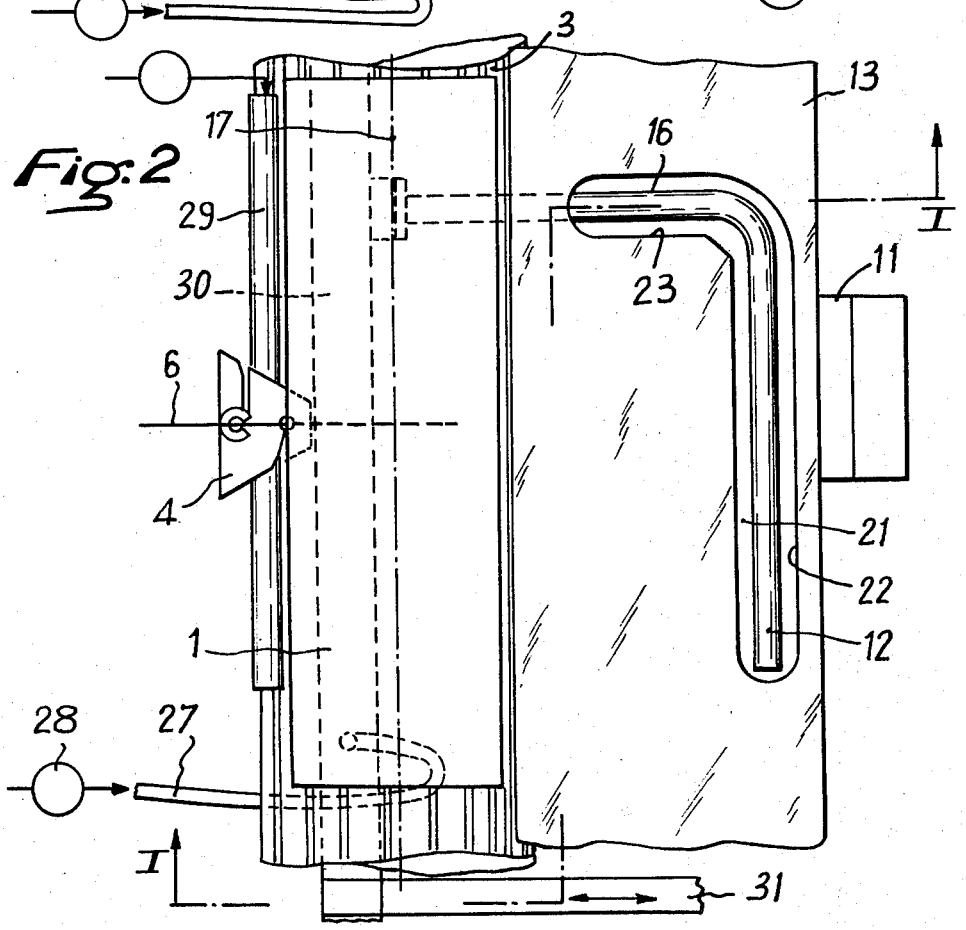
FIG.2 is a fragmentary plan view corresponding to FIG. 1.
Figure 5:
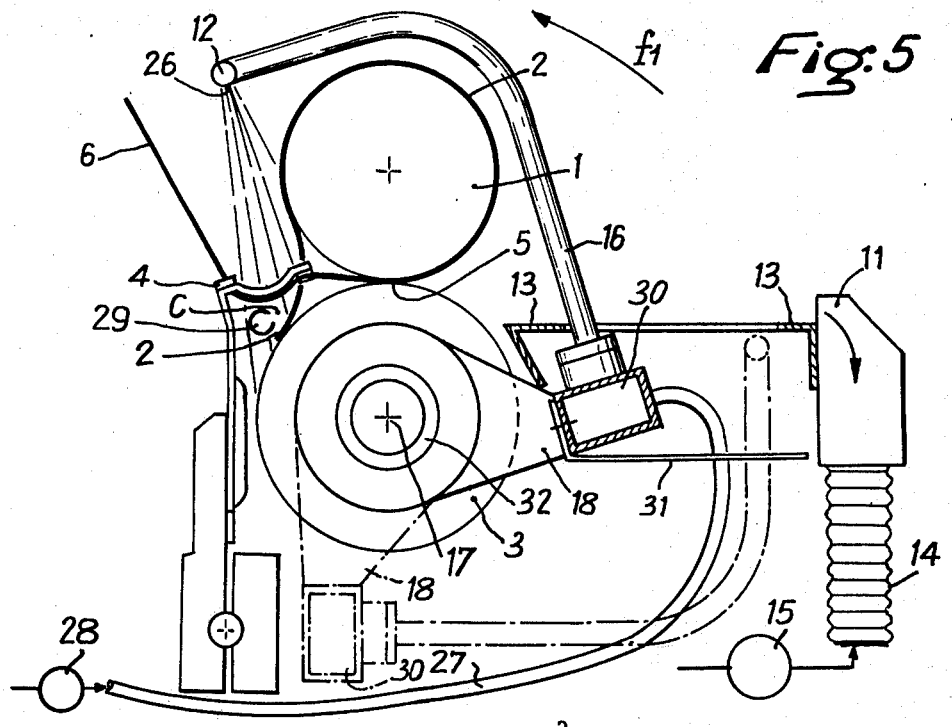
FIG. 5 is a view similar to FIGS. 1 and 3, but illustrating the leading end of the roving having been formed into a bight around the slubbing bobbin.
Figure 6:
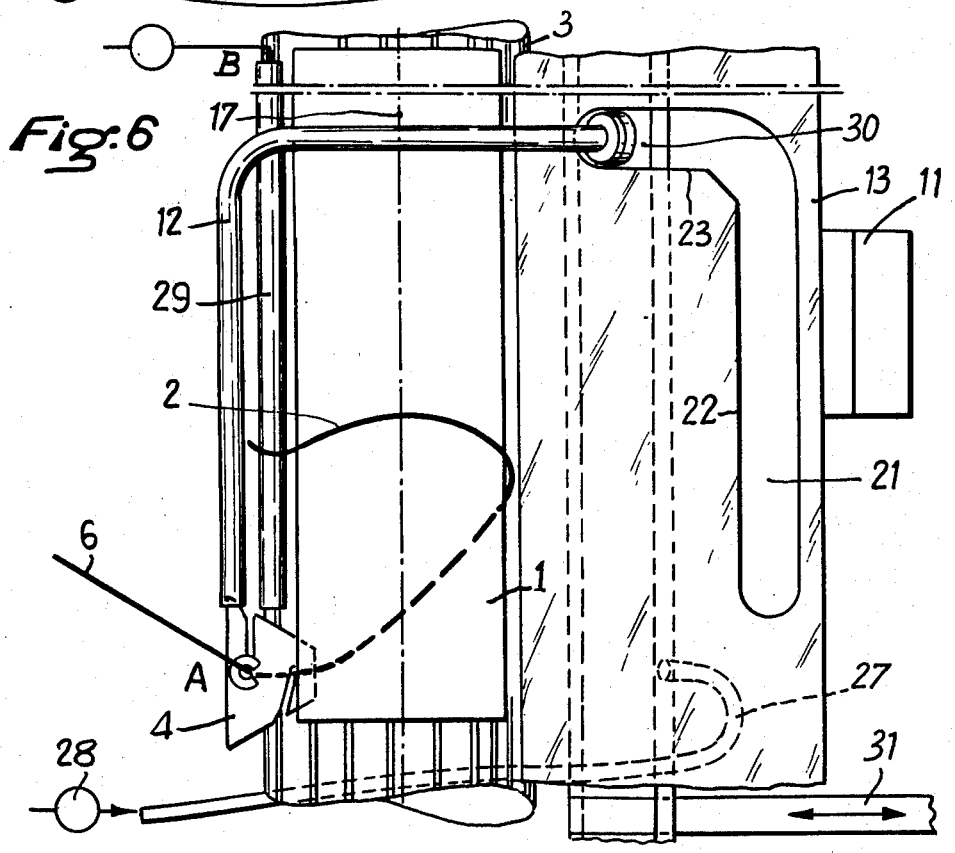
FIG. 6 is a fragmentary plan view corresponding to FIG. 5.

Thus the bight-forming finger 12 can oscillate parallel to itself from a position of rest which is shown in FIGS. 1 and 2 and in which it is located just below the level of the suction nozzle 11 for the roving end 2, that is to say below the space defined between the generatrix of contact 5 and the suction nozzle 11, and an operative position which is shown in FIGS. 5 and 6 and in which it is located above and behind the slubbing bobbin 1.

The table 13 is horizontal and extends from adjacent the generatrix of contact 5 up to the suction nozzle 11 for the roving end 2, substantially at the level of the said generatrix of contact 5 and, preferably, slightly below this latter so that the roving end 2 can be deposited on the table 13 and slide easily down said table 13 at the start of a cycle for positioning of the roving end 2 on the slubbing bobbin 1. The table 13 has an opened 21 through which the bight-forming finger 12 is withdrawn in the position of rest. This opening 21 comprises a rectilinear portion 22 parallel to the axis 17 of the driving cylinder 3 for passage of the bight-forming finger 12 and a further rectilinear portion 23, disposed perpendicular to the portion 22, for the passage of the arm 16 which carries the bight-forming finger 12.

The bight-forming finger 12 has at least one air jet 26 which, when the bight-forming finger 12 occupies its operative position of FIGS. 5 and 6, is directed towards the space C comprised between the driving cylinder 3 and the slubbing bobbin 1 and leading to the nip between said cylinder 3 and bobbin 1, behind the latter that is to say on the upstream side. The air jet 26 is connected to a source of compressed air, under the control of an electrically-operated valve 28, by a piping 27 which is connected with the arm 16 through the medium of the conduit 30, the arm 16 and the bight-forming finger 12 being tubular.

Figure 3:
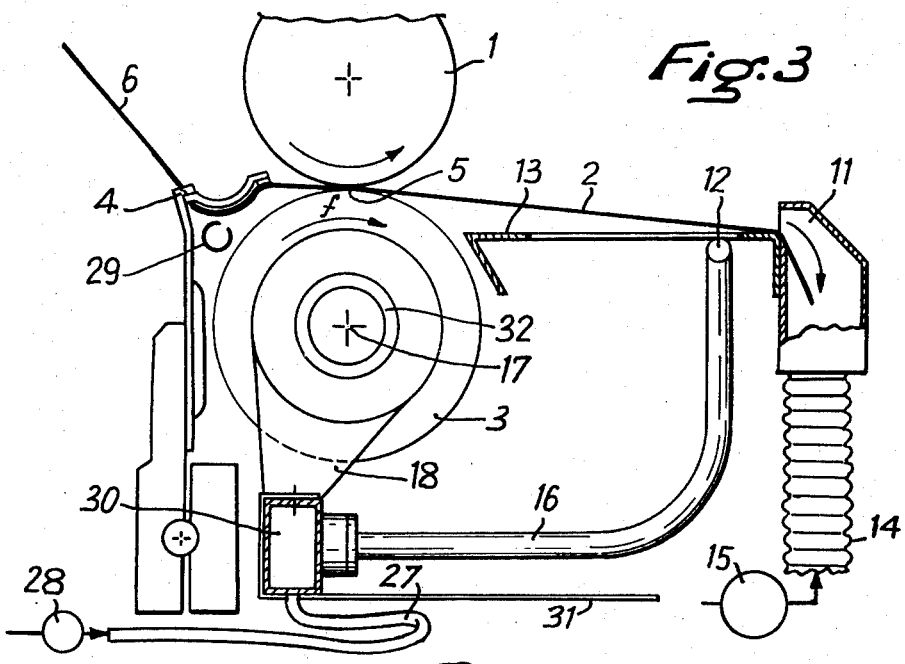
FIG.3 is a view similar to FIG. 1 but showing the leading end of the roving having been advanced and ready to be formed into a bight around the slubbing bobbin.
Figure 4:
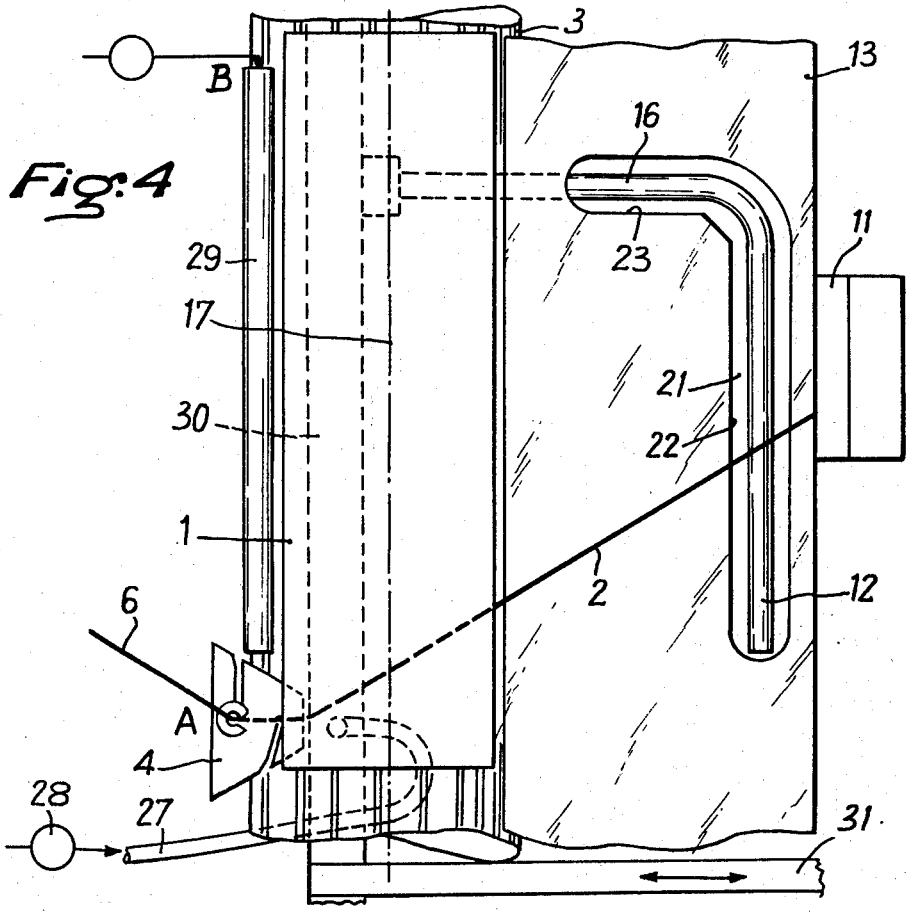
FIG.4 is a fragmentary plan view corresponding to FIG. 3.

The operation of the device is as follows:

Upon each loading of the machine, an empty slubbing bobbin 1 is brought into position on the driving cylinder 3 on which the leading end 2 of roving 6 is resting as shown in FIGS. 1 and 2. One begins by extending the leading end 2 of the roving by an initial jerk of the drive imparted by the driving cylinder 3, and thereby to the slubbing bobbin 1, so that the tip of the roving end 2 slides over the table 13, being guided in this movement by the suction effect of the nozzle 11 which takes up the terminal portion of the said roving end 2. During this, the roving guide 4 brings itself, with the roving 6, to one end of the slubbing bobbin 1 as indicated at A in FIG. 4. The advance of the roving is then stopped and the bight-forming finger 12 is caused to pass from its position of rest, which it still occupies in FIGS. 3 and 4, to its upper operative position of FIGS. 5 and 6, by a pivoting movement in the direction of the arrow *f*1. The bight-forming finger 12, upon engaging the end of the roving 2 causes it to pass upwards and then over the slubbing bobbin 1. Thereupon the jet 26 is fed with compressed air so that the compressed air which emerges therefrom finishes off the forming of the roving into a bight, around the slubbing bobbin 1, in a reliable manner, with the leading end entering the nip between the driving cylinder 3 and the slubbing bobbin 1, at the upstream side of the generatrix of contact 5. The machine is then re-started up and the roving guide 4 shifts, with the roving 6, towards the other end B of the slubbing bobbin, which finishes the bight for the start of a knot of the roving around the slubbing bobbin 1. The clamping of the roving end against the slubbing bobbin ensures a very efficient anchorage of the start of the winding operation which, from then on, proceeds normally, the bight-forming finger 12 being brought back to its position of rests of FIGS. 1 to 4, under the table 13, and the feed of the compressed air jet 26 of the bight-forming finger 12 is interrupted. One also stops the action of the suction nozzle 11 for the roving end.

One could further provide for completion of the action of the elements described above by the addition of a supplementary nozzle 29 for suction or for blowing, which nozzle opens out into the zone C, upstream of the generatrix of contact 5, with a view to drawing or flattening the terminal portion of the roving end between the driving cylinder 3 and the slubbing bobbin 1. The nozzle 29 can suck the roving end, or perhaps blow thereon, which flattens it quite just as well between the driving cylinder 3 and the slubbing bobbin 1.

Of course, the invention is not restricted to the embodiment described and shown, and one can make modifications thereto, according to the applications envisaged, without departing from the scope of the following claims.

I claim :

1. A device for forming an initial bight of a roving around a slubbing bobbin at the commencement of winding, in an automatic textile winding machine, such as a spindle frame, an intersecting comber or the like, comprising a driving cylinder adapted for said slubbing bobbin to rest thereon and to be driven thereby, a roving guide adapted to be driven with a longitudinal reciprocating movement adjacent to the generatrix of contact of the slubbing bobbin and the driving cylinder, and pneumatic blowing means for applying the leading end of the roving to the slubbing bobbin, said device comprising a suction nozzle for said leading end of the roving and situated substantially at the level of said generatrix of contact at a spacing from said generatrix to the downstream side relative to the direction of rotation of said driving cylinder, and a bight-forming finger disposed parallel to said generatrix and adapted to oscillate, parallel to itself, between a rest position below the space between said generatrix and said suction nozzle, and an operative position in which it is located above and behind said slubbing bobbin, having entrained with it said roving end in passing from its said rest position to its said operative position, said finger having at least one air jet which, when said bight-forming finger is in its operative position, is directed towards the nip between said driving cylinder and said slubbing bobbin, behind the latter at the upstream side thereof, and which jet is then connected temporarily to a source of compressed air.

2. The device as set forth in claim 1, further comprising a horizontal table extending from adjacent said generatrix to said suction nozzle and having an opening, said bight-forming finger in said position of rest being withdrawn beneath said table through said opening.

3. A device as claimed in claim 1, wherein said bight-forming finger is integral with an angled arm which pivots about an axis coincident with the axis of said driving cylinder.

4. A device as claimed in claim 1, wherein a suction nozzle is disposed in the vicinity of said driving cylinder to the upstream side of said generatrix of contact.

* * * * *